US005913411A

United States Patent [19]

Spurling

[11] Patent Number: 5,913,411

[45] Date of Patent: Jun. 22, 1999

[54] DEVICE FOR COMPRESSING AND CONCEALING A BOOT WITHIN A TROUSER LEG

[76] Inventor: Michael A. Spurling, 116 Wiegel, St. Louis, Mo. 63135

[21] Appl. No.: 09/147,000

[22] Filed: Sep. 4, 1998

[51] Int. Cl.[6] ..... A41F 17/00

[52] U.S. Cl. ..... 2/312; 2/308; 2/313; 2/315; 2/232; 36/136

[58] Field of Search ..... 2/231, 232, 233, 2/302, 308, 311, 312, 313, 314, 315, 319, 323, 338, 242, 240; 36/1, 58.5, 1.5, 70 R, 71.5, 109, 136

[56] References Cited

U.S. PATENT DOCUMENTS

| | | | |
|---|---|---|---|
| 282,954 | 8/1883 | Byrnes | 36/58.5 |
| 439,909 | 11/1890 | Teggart | 36/58.5 |
| 722,274 | 3/1903 | Bauer | 2/308 |
| 975,815 | 11/1910 | White | 36/58.5 |
| 1,361,565 | 12/1920 | Christy | 2/313 |
| 1,499,167 | 6/1924 | Frisch | 2/240 |
| 1,666,017 | 4/1928 | Lininger | 2/313 |
| 1,685,561 | 9/1928 | Bunker | 36/58.5 |
| 1,874,461 | 8/1932 | Crowley | 36/1 |
| 2,293,791 | 8/1942 | Baird | 2/315 |
| 2,596,112 | 5/1952 | Aines | 2/314 |
| 3,177,498 | 4/1965 | Sadowski . | |
| 3,286,375 | 11/1966 | Troy . | |
| 3,733,615 | 5/1973 | Jaffee . | |
| 4,393,522 | 7/1983 | Calabrese . | |
| 4,825,475 | 5/1989 | Smart | 2/312 |
| 4,941,213 | 7/1990 | Grillliot et al. . | |
| 5,214,805 | 6/1993 | Cochran | 2/232 |
| 5,542,156 | 8/1996 | Oglesby . | |

*Primary Examiner*—Amy B. Vanatta
*Attorney, Agent, or Firm*—Kenneth L Tolar

[57] ABSTRACT

A device for compressing and concealing a boot beneath a trouser leg includes an elongated panel having an inner side, an outer side, a bottom end and a top end. Secured to the top end is a buckle means for securing the panel to a boot strap. A pair of length adjustable straps extend from the panel for encircling and compressing the upper portion of a boot. Accordingly, the compressed upper portion of the boot may be easily inserted into a pants leg and concealed therewithin.

9 Claims, 1 Drawing Sheet

DEVICE FOR COMPRESSING AND CONCEALING A BOOT WITHIN A TROUSER LEG

BACKGROUND OF THE INVENTION

The present invention relates to a device for compressing the upwardly extending portion of a boot to allow a trouser leg to be easily slid thereover.

DESCRIPTION OF THE PRIOR ART

Wearing high fitting boots such as cowboy boots has long been a problem in that the upwardly extending portion has a circumference that is at least as large as the average trouser leg portion. Accordingly, it is difficult and burdensome to slide the trouser legs over such boots.

Furthermore, the upper portions of the boot bulge within the trouser leg which is unsightly. Accordingly, there is currently a need for a device which conveniently compresses the upper portion of a boot tightly against a wearer's leg allowing the boot to be easily and concealably inserted within a trouser leg. Various boot attachments exist in the prior art, most of which are designed to secure a trouser leg to the boot. For example, U.S. Pat. No. 5,542,156 issued to Oglesby relates to a trouser leg retaining device comprising snap fasteners attached to a trouser leg for engaging a restraining device that is placed across the sole of a shoe or boot.

U.S. Pat. No. 4,941,213 issued to Grilliot et al relates to a firefighter's boot and trouser attachment. The attachment device relates to a band having a strap extending therefrom. The strap contains fastener elements which attach to portions of the firefighter's trousers.

U.S. Pat. No. 4,393,522 issued to Calabrese relates to an ankle garter with foot stirrups. The device includes an open ended garter band with a U-shaped stirrup depending therefrom.

U.S. Pat. No. 3,733,615 issued to Jaffee relates to a ski cuff insertable inside each leg portion of a pair of stretch pants having a pair of elastic bands designed to firmly hold the cuff piece onto a ski boot.

U.S. Pat. No. 3,286,375 issued to Troy relates to a boot having a pant leg retaining means comprising a hook and buckle attached to the top edge of the boot upper portion.

U.S. Pat. No. 3,177,498 issued to Sadowski relates to stays for trousers including a strap extending beneath the wearer's foot and upwardly into opposing sides of a trouser leg.

As indicated above, various boot attachments and similar structures exist in the prior art. However, each of these devices relates to a means for securing a trouser leg about or within a boot. The present invention, on the other hand, relates to a device for compressing a boot to assist a user in placing a pant leg thereover and to conceal the boot therewithin.

SUMMARY OF THE INVENTION

The present invention relates to a boot compression device comprising an elongated panel member having an inner surface, an outer surface, a top end and a bottom end. On the inner surface are a plurality of projections for frictionally engaging the exterior surface of a boot. The top end is formed of a loop having a buckle member secured thereto for securing the panel to a conventional boot strap. The inner surface of the panel has upper and lower pairs of opposing slits each pair for receiving a strap. The upper strap has a pair of terminal ends, each having a coupling member thereon for tightly securing the strap about the upper portion of a boot to compress the boot against a wearer's leg. Received within the lower pair of slits is a second strap having a pair of terminal ends with a hook and loop fastener at each end for further compressing the boot. It is therefore an object of the present invention to provide a device for compressing a boot that allows a user to easily place trouser leg portions thereover.

It is yet another object of the present invention to provide a device for compressing a boot that allows the boot to be conveniently concealed beneath a wearer's trousers.

It is yet another object of the present invention to provide a device for compressing a boot that is easy to use and inexpensive to manufacture.

Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
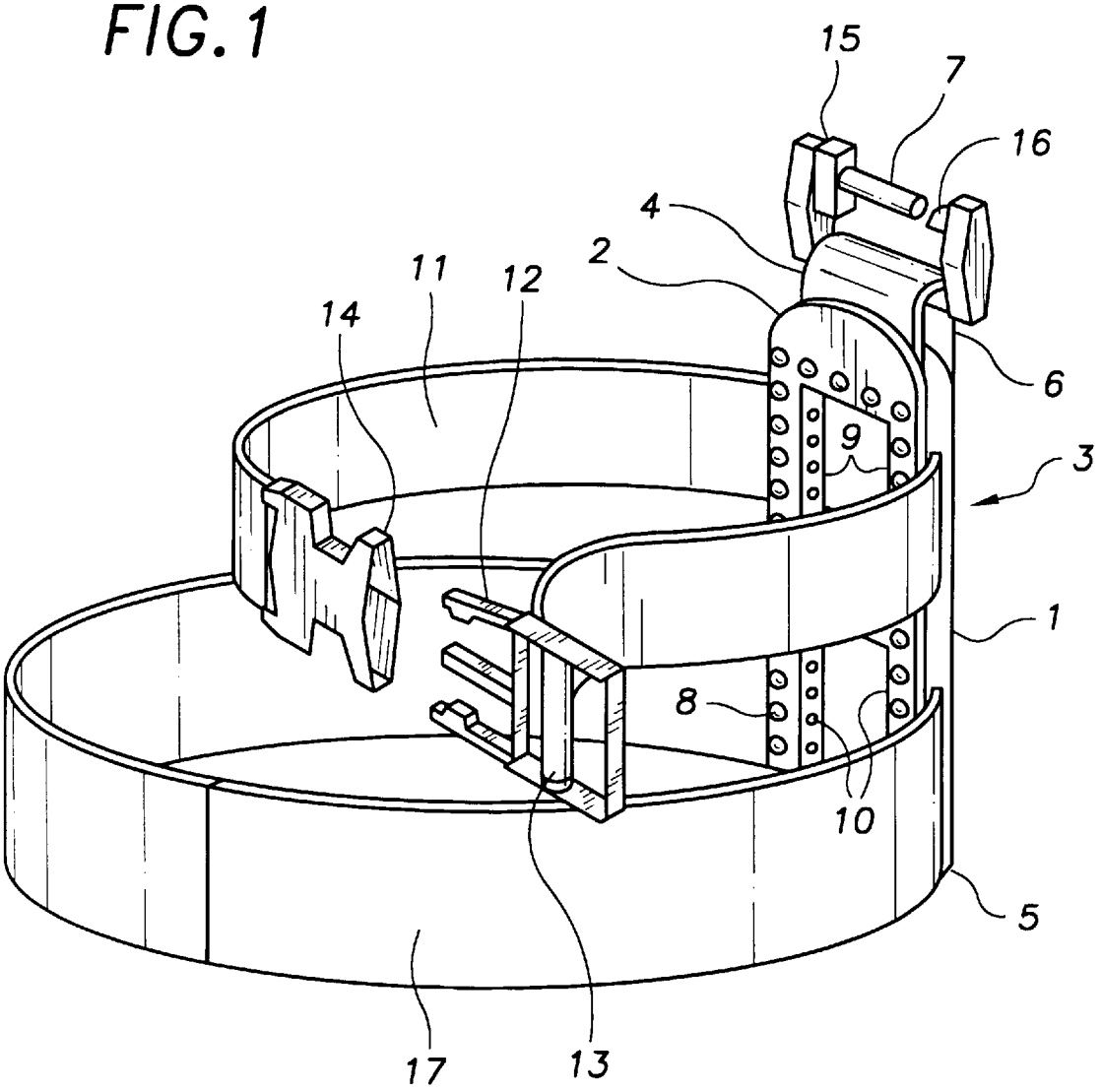
FIG. 1 depicts the inventive device.

A boot such as a cowboy boot typically includes a foot portion with an upper portion vertically extending therefrom that terminates at a top distal edge. The top distal edge often includes a loop often referred to as a boot strap which may be grasped when inserting a foot therein. Referring now to FIG. 1, the present invention relates to a device that assists a user in placing trouser legs over the upper portion of a boot. The device comprises an elongated panel member 1 having an inner surface 2, an outer surface 3, a top end 4 and a bottom end 5. The top end includes a loop 6 wrapped about a portion of a substantially D-shaped buckle member 15. The D-shaped buckle member 15 includes a cross member 7 extending from a side of the buckle and a shank 16 extending from an opposing side. A portion of the boot strap may be inserted between the shank and cross member to secure the panel to a boot.

Peripherally disposed about the inner surface of the panel member are a plurality of projections 8 for frictionally engaging the exterior surface of the boot to prevent the device from shifting relative thereto. The inner surface contains upper 9 and lower pairs 10 of opposing slits or openings. The upper pair of slits receive an upper strap 11 having a pair of opposing terminal ends. A first terminal end has a conventional, three pronged male connector 12 member thereon. The connector 12 includes a clasp portion 13 about which the strap 11 is wrapped allowing the length of the strap to be selectively adjusted. A second terminal end of the strap has a female connector 14 thereon for coupling with the male connector to secure the upper strap about the periphery of the boot upper portion.

Received within the lower pair of slits is a lower strap member 17 having a pair of terminal ends, each with a hook and loop fastener thereon. The lower strap may be secured about the upper portion of the boot immediately below the upper strap to further compress and conceal the boot within a trouser's leg.

The elongated panel is preferably constructed with leather or rubber while the straps are preferably constructed with a nylon webbing material or suitable equivalent. The connector members and buckle member are preferably constructed with plastic. However, as will be readily apparent to those skilled in the art, the size, shape and materials of construction of the various components may be varied without departing from the spirit of the present invention. Any suitable attachment means may be used to secure the upper and lower straps about a boot such as snaps, buttons and similar means.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A device for compressing and concealing the upper portion of a boot within a trouser leg comprising:

an elongated panel member having a top end, a bottom end, an inner side and an outer side;

means for securing said panel member to a boot strap;

an upper strap having a selectively variable length extending from said panel securable about the upper portion of a boot for surrounding and compressing said upper portion.

2. A device according to claim 1 further comprising a lower strap having a selectively variable length extending from said panel securable about the upper portion of a boot for surrounding and compressing said upper portion.

3. A device according to claim 1 wherein said means for securing said panel to a boot strap comprises a buckle member secured to the top end of said panel.

4. A device according to claim 1 further comprising a plurality of projections on the inner side of said panel for frictionally engaging the exterior surface of a boot.

5. A device according to claim 1 wherein said upper strap includes a pair of terminal ends each having a fastener means thereon to removably secure the strap about the upper portion of a boot.

6. A device according to claim 2 wherein the lower strap includes a pair of terminal ends each having an attachment means thereon for removably securing the strap about the upper portion of a boot.

7. A device according to claim 5 wherein said fastener means is a female connector at a first terminal end and a male connector at a second terminal end, said male connector dimensioned to be removably seated within said female connector.

8. A device according to claim 6 wherein said attachment means is a hook and loop fastener.

9. A device according to claim 3 wherein said buckle is D-shaped having two opposing sides with a cross member extending from a first side and a shank member extending from the opposing side, the space between which removably receives a boot strap.

* * * * *